US005566820A

United States Patent [19]

Deaton

[11] Patent Number: 5,566,820

[45] Date of Patent: Oct. 22, 1996

[54] DUST MOP PACKAGE

[75] Inventor: Timothy E. Deaton, Brookville, Ohio

[73] Assignee: Vining Industries, Inc., Springfield, Ohio

[21] Appl. No.: 441,017

[22] Filed: May 15, 1995

[51] Int. Cl.[6] ..... B65D 65/12

[52] U.S. Cl. ..... 206/15.3; 206/362.4; 229/87.01

[58] Field of Search ..... 206/361, 362.4, 206/15.2, 15.3; 229/87.01

[56] References Cited

U.S. PATENT DOCUMENTS

| | | | |
|---|---|---|---|
| 1,931,293 | 10/1933 | Morck | 206/362.4 |
| 2,290,359 | 7/1942 | Ringler | 206/362.4 |
| 2,300,845 | 11/1942 | Raszewski . | |
| 2,506,821 | 5/1950 | White | 206/362.4 |
| 2,841,273 | 7/1958 | Scott | 206/362.4 |
| 2,979,189 | 4/1961 | Allen | 206/362.4 |
| 3,860,115 | 1/1975 | Laske . | |
| 4,606,456 | 8/1986 | Kaminski | 206/362.4 |
| 4,826,006 | 5/1989 | Chainard . | |
| 5,085,316 | 2/1992 | Pearce et al. | 206/362.4 X |
| 5,358,107 | 10/1994 | Laske . | |

FOREIGN PATENT DOCUMENTS

| | | | |
|---|---|---|---|
| 458201 | 8/1968 | Switzerland | 206/361 |

*Primary Examiner*—Bryon P. Gehman
*Attorney, Agent, or Firm*—Biebel & French

[57] ABSTRACT

A mop package for use with a mop including a mop head and a handle pivotally connected to the mop head. The package includes a body portion for receiving the mop head and a biasing portion connected to the body portion. The biasing portion includes an aperture for receiving the handle of the mop and is formed with a triangular configuration which facilitates biasing the mop head to an orientation where it is substantially parallel to the handle of the mop.

16 Claims, 6 Drawing Sheets

A
24
26
28
34
10
12
36
22
16
20
30
42
18
44
48
46
14

24
26
28
34
38
36
162
20
30
88
156
80
90
144
128
136
94
146
158
140

DUST MOP PACKAGE

BACKGROUND OF THE INVENTION

1. Field of the Invention

The present invention relates to a display package, and more particularly, to a package for attachment to the head portion of a dust mop.

2. Description of the Prior Art

Packaging for cleaning implements having a handle and head portion, such as mops or brooms, typically includes a protective sleeve or container which fits over the head portion of the implement. The sleeve or container usually serves a dual purpose of protecting the head portion of the implement as well as providing a surface for printed matter to facilitate advertisement of the implement.

For example, U.S. Pat. No. 3,860,115 discloses a protective sleeve for a broom including a tapered sleeve enveloping bristles of the broom to thereby protect the head of the broom. U.S. Pat. No. 2,300,845 discloses a package for supporting and displaying a mop, the package including a blank forming a rigid support and surrounded by a transparent wrapper which may include printed matter or decoration. In another known package for enclosing a mop head, a plastic shell is provided in combination with cardboard to enclose and protect the mop head.

In a known type of mop, the head of the mop is spring biased relative to a handle of the mop such that the mop head tends to move to a position approximately perpendicular to the handle. In displaying such a mop, it is desirable to maintain the mop head and handle substantially parallel to each other in order to provide a compact and attractive appearance for the mop. Accordingly, it is necessary-to provide a package or container for the mop head which is capable of maintaining the head in the desired position. It has proven difficult to provide such a package which is also formed as a relatively simple construction permitting display of at least a portion of the mop head.

SUMMARY OF THE INVENTION

The present invention provides a mop package for use with a mop including a mop head and a handle pivotally connected to the mop head. The package comprises a body portion for receiving the mop head and a biasing portion connected to the body portion. An aperture is defined in the biasing portion for receiving the handle therethrough whereby engagement of the aperture with the handle causes the mop head to be biased rearwardly relative to the handle.

The body portion of the package includes front and rear walls for engaging front and rear portions of the mop head and the biasing portion includes front and rear panels wherein the aperture for receiving the handle is defined in the rear panel. The front and rear panels angle toward each other in a direction away from the body portion to thereby form a substantially triangular open sided enclosure below the body portion. In addition, a base portion is defined extending between the front and rear walls adjacent to a junction between the front and rear walls and the front and rear panels.

The front wall includes a lip portion extending downwardly beyond the base portion to define a corner between the lip portion and the base portion. The front and rear panels angle toward each other toward a common fold line and an edge of the front panel extends into abutting engagement with the corner. Thus, as the mop head tends to pivot forwardly, the handle will engage within the aperture of the biasing portion to cause the forward panel to push against the corner to thereby resist relative pivotal movement between the mop head and the handle.

Therefore, it is an object of the present invention to provide a package for a mop.

It is a further object of the invention to provide a package for a mop wherein the package maintains a mop head in a desired position relative to a handle of the mop.

It is yet another object of the invention to provide a package for a mop wherein at least a portion of the mop head is visible through the package.

Other objects and advantages of the invention will be apparent from the following description, the accompanying drawings and the appended claims.

DETAILED DESCRIPTION OF THE PREFERRED EMBODIMENT

Figure 1:
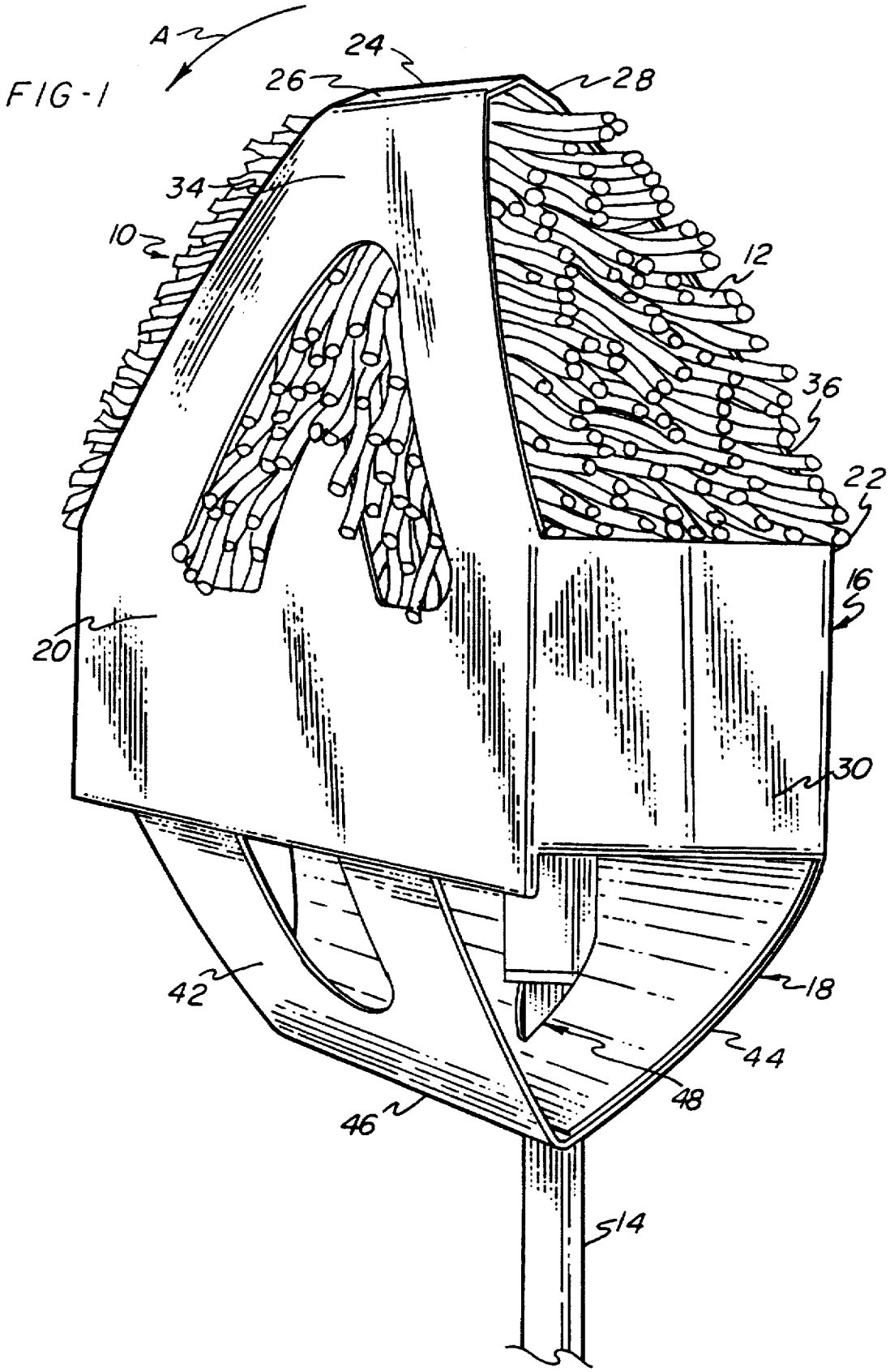
FIG. 1 is a perspective view of a mop package in accordance with the present invention containing the head portion of a mop.

Referring to FIG. 1, the mop package 10 of the present invention is illustrated mounted to a mop including a mop head 12 and a handle 14 wherein the mop head 12 is pivotally connected to the handle 14. Further, the mop head 12 and handle 14 are typically spring biased relative to each other such that the mop head 12 will tend to pivot in the direction A relative to the handle 14. The mop package 10 includes a body portion 16 for receiving the mop head 12 and a biasing portion 18 connected to the body portion 16 for engaging the handle 14.

Figure 2:
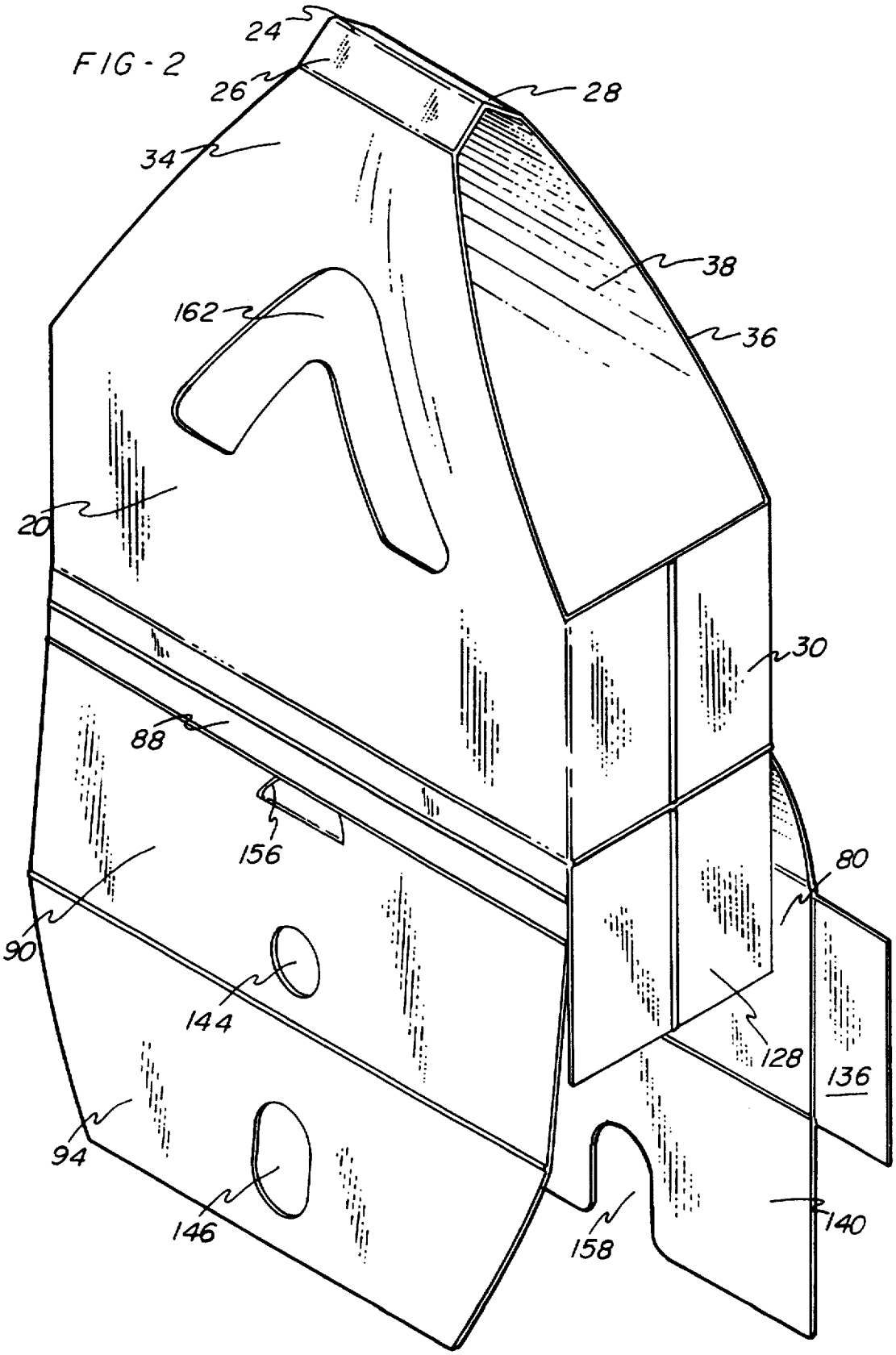
FIG. 2 is a front perspective view of the mop package of the present invention with the front and rear flaps unfolded.
Figure 3:
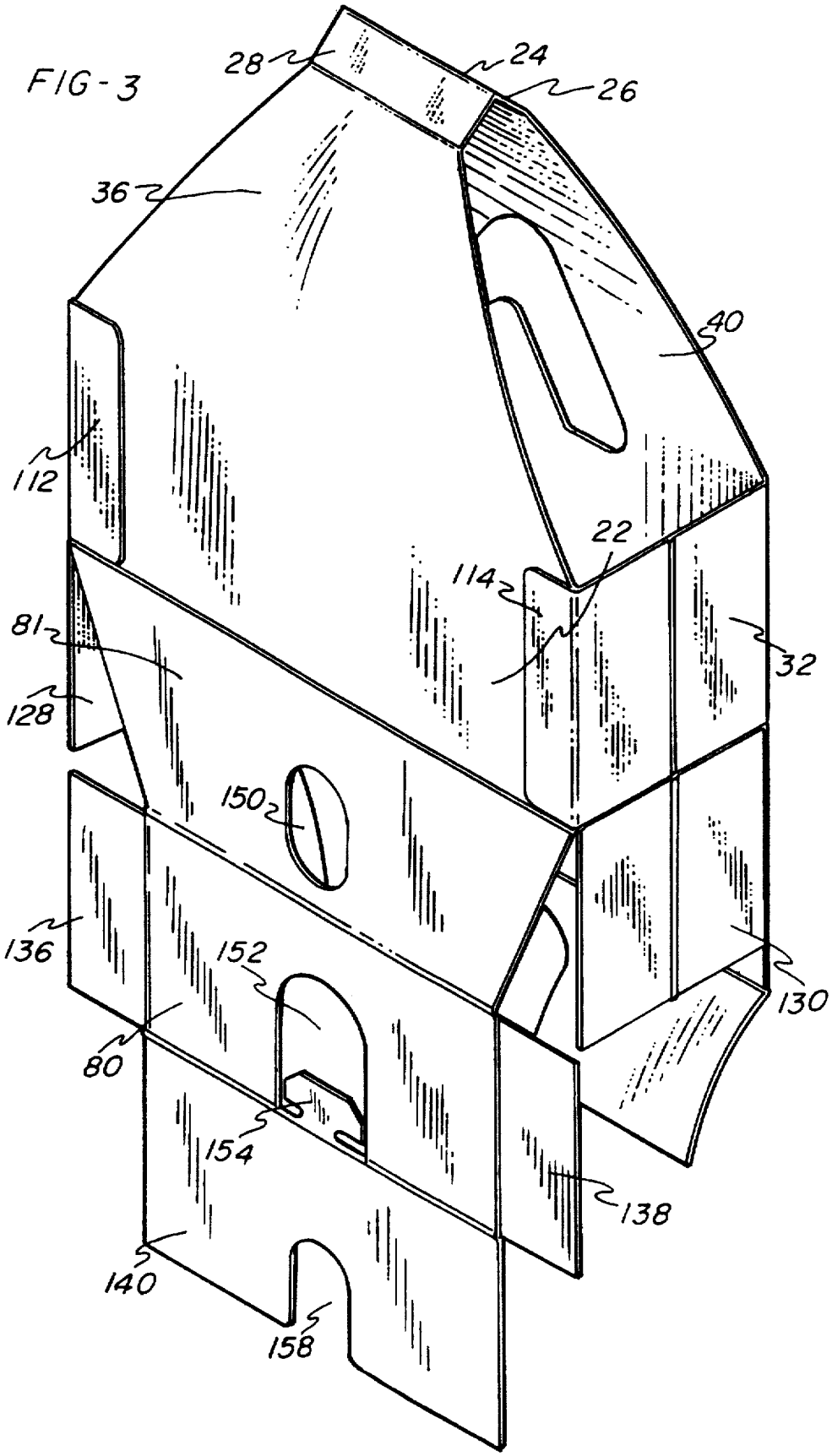
FIG. 3 is a rear perspective view of the mop package of FIG. 2.
Figure 4:
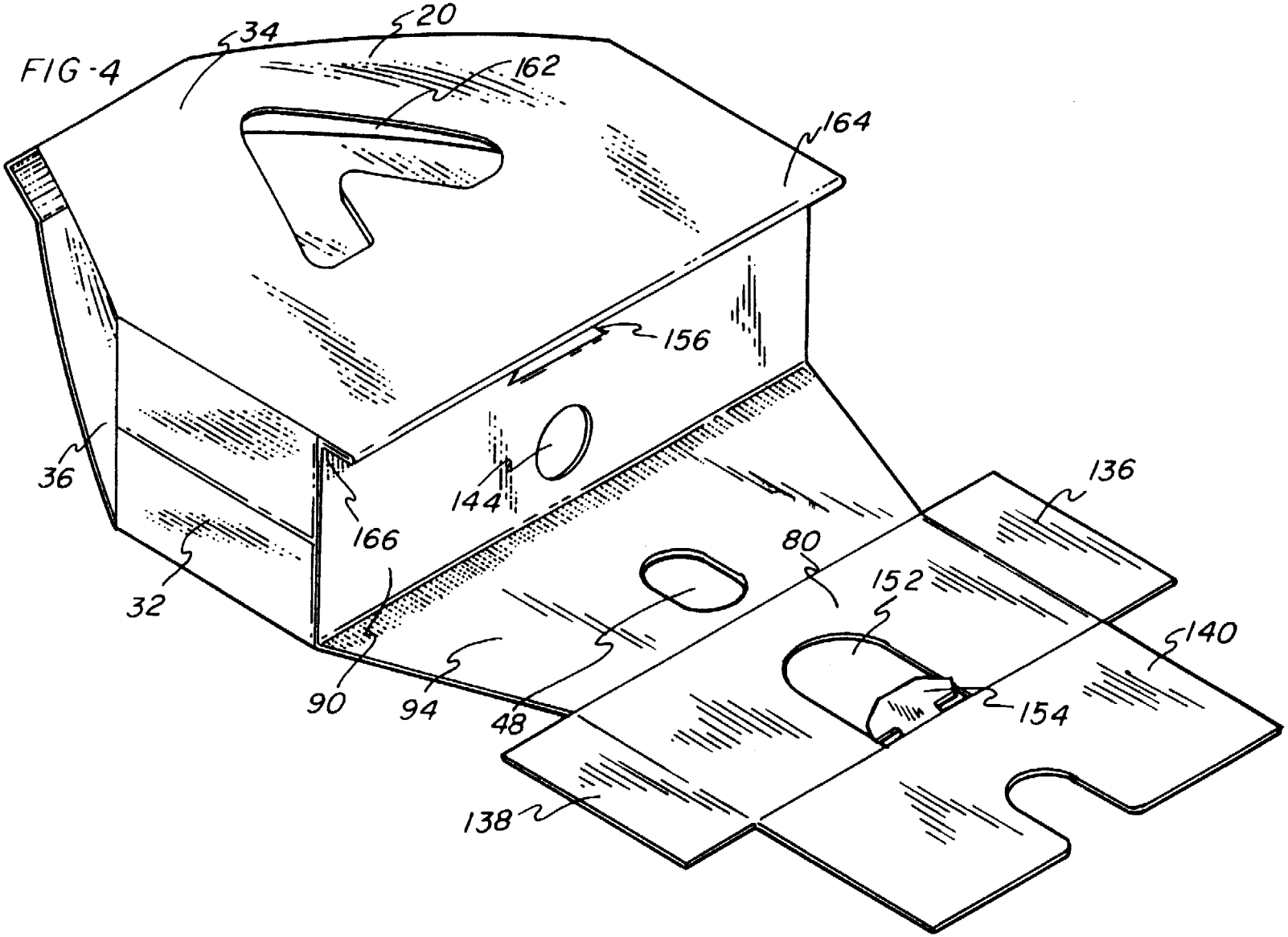
FIG. 4 is a perspective view of the mop package with the front flap folded.

Referring to FIGS. 1–3, the body portion 16 includes a front wall 20 and rear wall 22 connected to each other by a top connector portion 24. The top connector portion includes adjacent first and second top panels 26, 28 which angle toward each other. The body portion 16 further includes opposing side walls 30, 32. Front and rear top portions 34, 36 of the front and rear panels 20, 22 angle inwardly toward each other in a direction from the side walls 30, 32 to the top connector portion 24 to define open side portions 38, 40 through which the mop head 12 may be viewed.

The biasing portion 18 includes a front panel member 42 and a rear panel member 44 which angle toward each other and meet at a lower apex at 46. The biasing portion 18 defines an open sided enclosure formed as a substantially triangular configuration which contributes to forming the biasing portion 18 as a substantially rigid structure. In addition, the rear panel member 44 includes means defining an aperture 48 for receiving the handle 14 therethrough.

Figure 6:
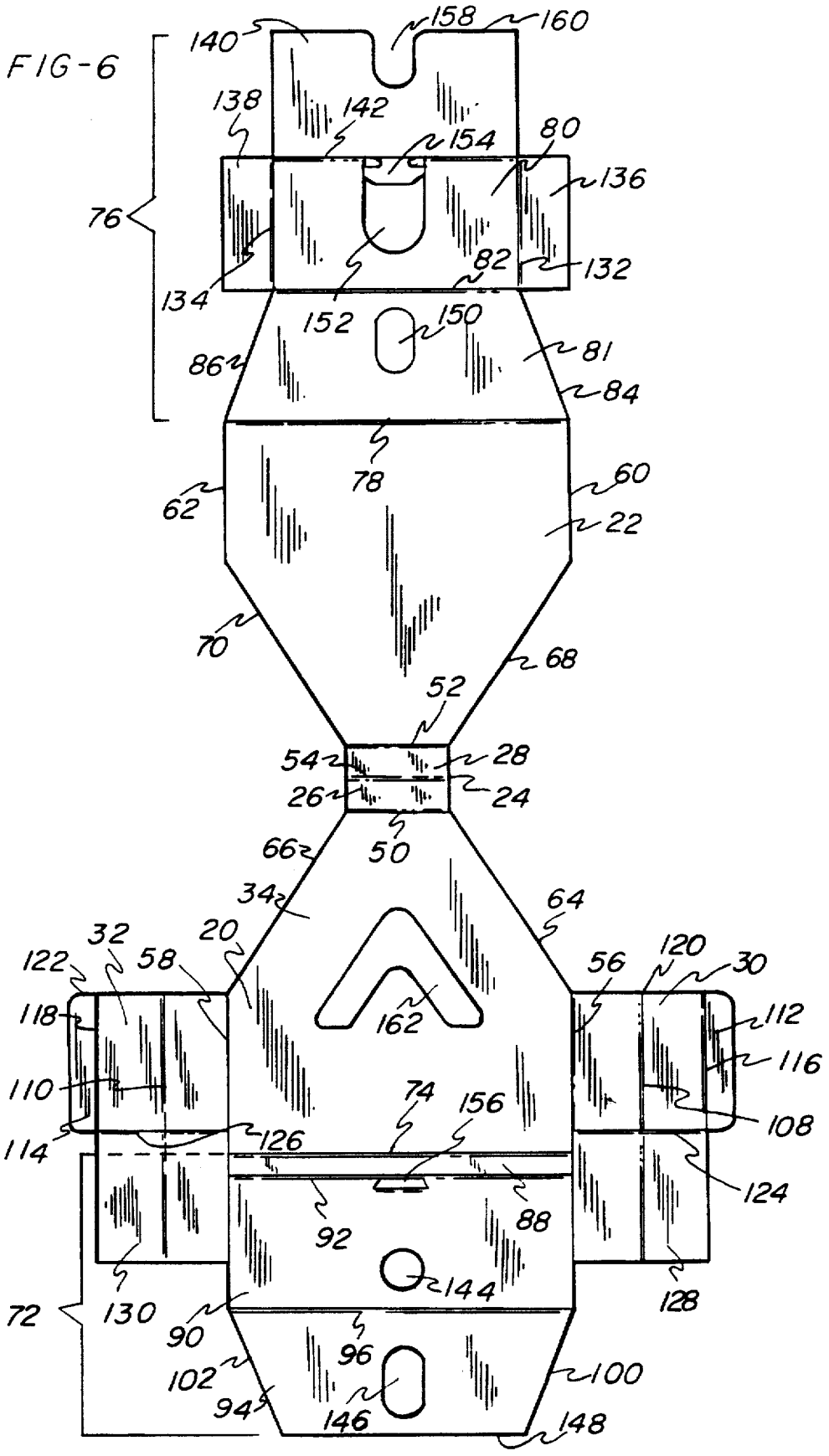
FIG. 6 is a plan view of a blank for use constructing the mop package of the present invention.

Referring to FIG. 6, a blank for forming the package 10 is illustrated in a flattened condition prior to folding to obtain the configuration shown in FIG. 1. Preferably the blank is formed from a planar sheet of cardboard or an equivalent material. The front wall 20 and rear wall 22 are joined to the top connector portion 24 at respective first and second fold lines 50 and 52. In addition, the top connector portion includes a central fold line 54 located between the first and second top panels 26, 28 of the top connector portion 24.

The front wall 20 includes a pair of substantially parallel side edges 56, 58 extending perpendicular to the fold lines 50, 52, 54. Similarly, the rear wall includes a pair of substantially parallel opposing side edges 60, 62 which are also perpendicular to the fold lines 50, 52, 54.

The top portion 34 of the front wall includes angled upper side edges 64, 66 which angle inwardly from the side edges 56, 58 toward the top connector portion 24. In a similar manner, the rear wall 22 includes angled upper side edges 68, 70 which angle inwardly from the side edges 60, 62 toward the top connector portion 24.

A front flap 72 is attached to the front wall along a third fold line 74 which is parallel to and at an opposite end from the first fold line 50 on the front wall 20. A rear flap 76 is attached to the rear wall 22 along a fourth fold line 78 which is parallel to and located opposite from the second fold line 52 on the rear wall 22. The rear flap 76 defines the rear panel member 44 as well as a front panel 80 which is connected to primary rear panel 81 at a fifth fold line 82 parallel to the fourth fold line 78. It should be noted that the primary rear panel 81 includes angled side edges 84, 86 which angle inwardly from the fourth fold line 78 toward the fifth fold line 82.

The front flap 72 includes a thin connector portion or lip member 88 and a first base member 90 is attached to the thin connector portion 88 at a sixth fold line 92. Further, the side edges 56, 58 of the front wall extend to form the side edges for the thin connector portion 88 and the first base member 90.

A secondary rear panel 94 is connected to the first base member 90 at a seventh fold line 96 which extends parallel to the first fold line 50, third fold line 74 and sixth fold line 92 associated with the front wall 20. The secondary rear panel 96 includes angled side edges 98, 100 which angle inwardly in a direction away from the seventh fold line 96.

The side walls 30, 32 extend laterally outwardly from the side edges 56, 58 of the front wall 20, and each side wall 30, 32 includes a respective medial fold line 108, 110. In addition, each side wall 30, 32 includes a respective connector flap 112, 114 attached at respective fold lines 116, 118. The side walls 30, 32 also include respective top edges 120, 122 and bottom edges 124, 126, and base flaps 128, 130 are attached to the side walls 30, 32 at fold lines defined along the bottom edges 124, 126.

Referring further to the rear flap 76, the front panel 80 includes a pair of parallel side edges 132, 134. A pair of panel flaps 136, 138 are attached to the front panel 80 at the side edges 132, 134 such that the side edges 132, 134 define fold lines between the panel flaps 136, 138 and the front panel 80. A second base member 140 is attached to the front panel member 80 along an eighth fold line 142 which is substantially parallel to the fifth fold line 82.

It should be noted that several of the portions of the front and rear flaps 72, 76 are provided with apertures for receiving the handle 14 of a mop therethrough. Specifically, the first base member 90 is provided with a circular aperture 144 adjacent to the seventh fold line 96, the secondary rear panel 94 is provided with an oblong aperture 146 adjacent to an edge 148, and the rear panel member 81 includes an oblong aperture 150 adjacent to the fifth fold line 82.

In addition, the front panel member 80 includes an access aperture 152, and a locking tab 154 extends into the access aperture 152 from the eighth fold line 142. The locking tab 154 is dimensioned to engage within a slot 156 defined centrally in the sixth fold line 92 of the front flap 72.

An additional slot 158 is also provided in an end edge 160 of the second base member 140 for accommodating the handle 14 of a mop. Also, the front wall 20 may be provided with an aperture 162 for facilitating viewing of the mop head 12 when it is located in the package of the present invention.

Referring to FIGS. 2–5, the folding of the blank will be described. The folding operation is shown without the mop head 12 in place, and it should be understood that the mop head 12 is normally positioned in the body portion 16 prior to folding.

Initially, the blank is folded along the central fold line 54, and the side walls 30, 32 are folded substantially perpendicular to the front wall 20 and rear wall 22 and the connector flaps 112, 114 are adhesively attached to an outer side of the rear wall 22, such that the package has the configuration shown in FIGS. 2 and 3. The base flaps 128, 130 are then folded such that they extend substantially perpendicular to the side walls 30, 32. The front flap 72 is then folded along the third fold line 74 such that the thin connector portion 88 doubles back along a lip extension 164 of the front wall and the first base member extends substantially perpendicular to the thin connector portion 88 in overlapping relationship over the base flaps 128, 130. In this position of the front flap 72, the secondary rear panel 94 is located adjacent to the primary rear panel 81 such that the primary rear panel 81 is located in overlapping relationship relative to the secondary rear panel 94 to define the rear panel member 44. In addition, the aperture 146 of the secondary rear panel 94 is aligned with the aperture 150 of the primary rear panel 81. At this stage of the folding procedure, the container has the appearance illustrated in FIG. 4.

Figure 5:
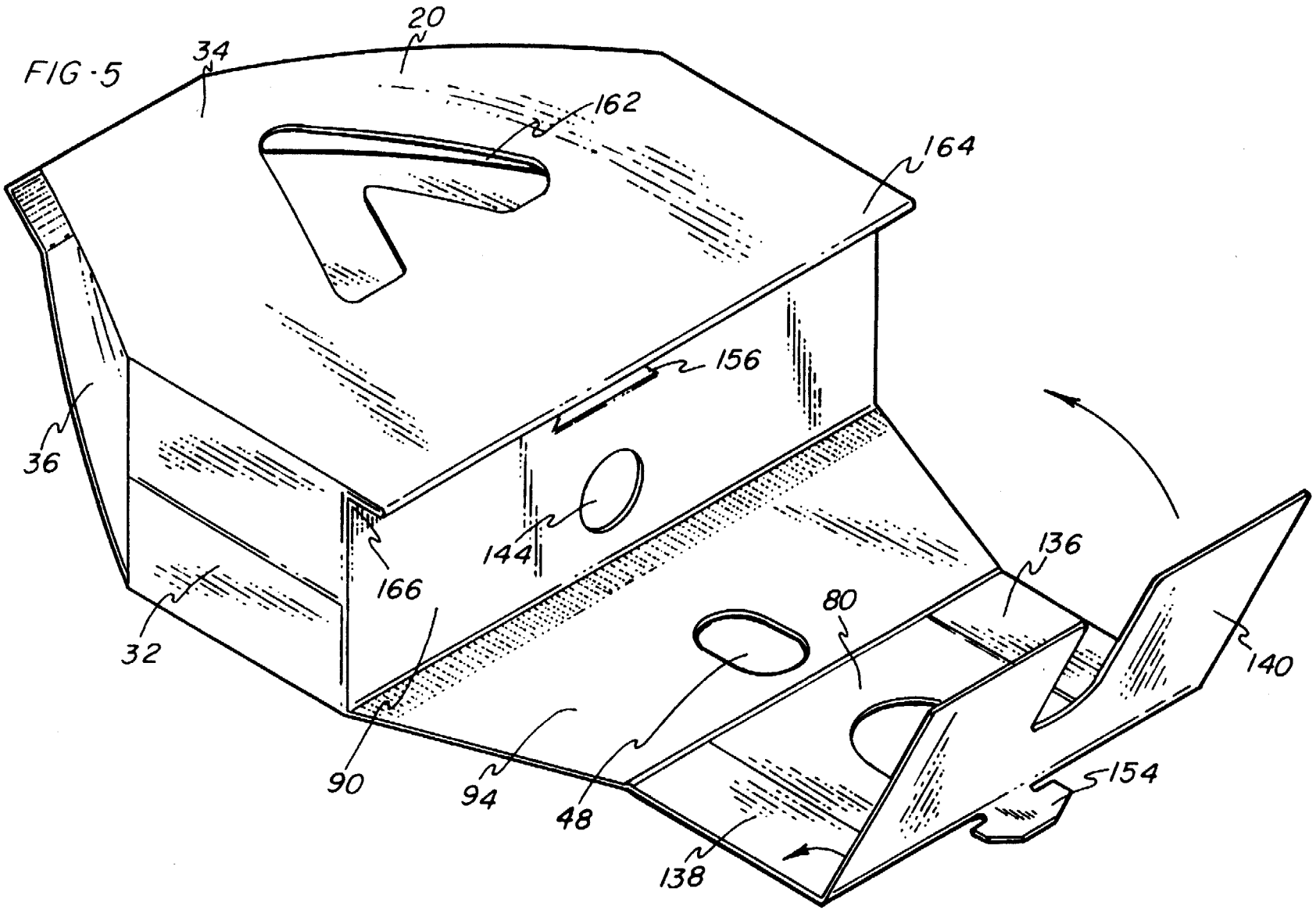
FIG. 5 is a perspective view of the mop package showing the rear flap folded in preparation for engagement of the front panel within the corner formed between the lip portion and the base portion.

As seen in FIG. 5, the panel flaps 136, 138 are then folded over the front panel member 80. The panel flaps 136, 138 are primarily provided to strengthen or reinforce the biasing portion 18 of the mop package 10. The front panel member 80 is then pivoted around the fifth fold line 82 to move the second base member 140 into position in overlapping relation over the first base member 90 to form a base portion for the package.

It should be noted that the thin connector portion 88 and adjacent lip extension 164 of the front wall 20 form a substantially rigid lip portion for the package and a corner 166 is defined between the lip portion and the base portion of the package. The slot 156 is located in the corner 166 and receives the locking tab 154 with the edge defined by the eighth folding line 142 in abutting engagement within the corner 166 to thereby lock the rear flap 76 in position. The access aperture 152 permits an operator assembling the package to access the tab 154 as it is inserted in the slot 156 and further permits the handle 14 to be viewed within the biasing portion 18.

It should be noted that by providing the apertures 146, 150, generally indicated as aperture 48 in the rear panel member 44, the handle 14 of the mop is caused to pass through the biasing portion 18 rearwardly of the lower apex defined at 46. As the mop head 12 tends to pivot forwardly relative to the handle 14, the handle 14 engages a lower edge of the aperture 48 to thereby limit pivoting movement. In addition, the edge of the front panel member 42 engaged in the corner 166 exerts a biasing force from the biasing portion 18 to the body portion 16 tending to bias the mop head 12 rearwardly and thereby maintain the mop head 12 substantially parallel to the handle 14.

It should be noted that when the mop is displayed with the package supported on a rack, engagement between the lower apex 46 and the rack will cause the mop head to further pivot rearwardly to facilitate maintaining the mop head substantially parallel to the handle.

From the above description, it should be apparent that the present invention provides a blank and package formed from the blank for enclosing a mop head. Further, the package is formed as a substantially rigid structure and is adapted to maintain the mop head in a desired orientation relative to the handle to thereby enhance the appearance of the mop when it is displayed.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A mop package for use with a mop including a mop head and a handle pivotally connected to the mop head, said package comprising:

a body portion for receiving a mop head, said body portion including a front wall and a rear wall;

a biasing portion connected to said body portion, said biasing portion including a front panel and a rear panel, said front and rear panels each extending from a respective junction with one of said front and rear walls wherein said rear panel is formed contiguously with said rear wall;

means defining an aperture in said rear panel of said biasing portion for receiving a handle therethrough; and a base portion extending between said front wall and said rear wall at said junctions, said base portion including an aperture for receiving a handle therethrough; and wherein said front and rear panels angle toward each other in a direction extending away from said base portion and away from said front and rear walls.

2. A mop package for use with a mop including a mop head and a handle pivotally connected to the mop head, said package comprising:

a body portion including a front wall and a rear wall for engaging front and rear portions of a mop head;

a biasing portion including a front panel and a rear panel connected to said body portion;

means defining an aperture in said rear panel of said biasing portion for receiving a handle therethrough; and including a base portion extending between said front and rear walls, said front wall including a lip portion extending beyond said base portion to define a corner between said lip portion and said base portion wherein said front and rear panels angle toward each other to a common fold line and an edge of said front panel extends into abutting engagement with said corner.

3. A mop package comprising:

a body portion including a front wall and a rear wall;

a pair of opposing side walls connecting said front and rear walls;

a front flap extending from said front wall and including a first base member;

a rear flap extending from said rear wall and including a front panel member and a rear panel member;

wherein said first base member defines a base portion extending substantially perpendicular to said from and rear walls, and said base portion and said from and rear walls define a body portion for containing a head of a mop; and wherein said front and rear panel members are connected to each other along a common fold line and define a substantially triangular open sided enclosure adjacent to said body portion.

4. The package as recited in claim 3 wherein said rear panel member includes means defining an aperture for receiving a handle of a mop therethrough.

5. The package as recited in claim 3 wherein said rear flap includes a second base member connected to said front panel member along a common fold line, said second base member located in overlapping relation over said first base member to form said base portion.

6. The package as recited in claim 3 wherein said front flap includes a thin connector between said front wall and said first base member, said front wall including a lip extension extending beyond said base portion and said thin connector located in overlapping relation over said lip extension to form a lip portion.

7. The package as recited in claim 6 wherein a corner is formed between said base portion and said lip portion, and an edge of said front panel member extends into abutting engagement with said corner.

8. The package as recited in claim 7 including a tab extending from said edge of said front panel member and a slot defined in said corner for receiving said tab whereby said rear flap is locked into position.

9. The package as recited in claim 8 including means defining an aperture in said front panel member adjacent to said tab for facilitating insertion of said tab into said slot.

10. The package as recited in claim 3 wherein said front flap includes a secondary rear panel member connected to said first base member along a common fold line, and said rear panel member is located in overlapping relation over said secondary rear panel member.

11. The package as recited in claim 3 including a top connector portion extending between said front and rear walls opposite said base portion wherein open side portions are defined between said side walls and said top connector portion.

12. A blank for a mop package comprising:

a front wall;

a rear wall;

a top connector portion connected to said front and rear walls at respective first and second fold lines;

a front flap connected to said front wall at a third fold line;

a rear flap connected to said rear wall at a fourth fold line;

a front panel and a rear panel defined by said rear flap wherein said front panel is connected to said rear panel by a fifth fold line and said rear panel includes an aperture formed therein;

a first base member defined by said front flap, said first base member including an aperture formed therein; and wherein said first, second, third, fourth, and fifth fold lines are parallel to each other.

13. The blank as recited in claim 12 wherein said front and rear walls each include opposing upper side edges which angle toward each other in a direction toward said top connector portion.

14. The blank as recited in claim 12 wherein said front flap includes a thin connector between said front wall and said first base member, and said first base member is connected to said thin connector by a sixth fold line.

15. The blank as recited in claim 14 including a slot formed through said front flap at said sixth fold line.

16. The blank as recited in claim 15 including a tab located at an edge of said front flap opposite from said fifth fold line wherein said tab is dimensioned to be received within said slot.

* * * * *

UNITED STATES PATENT AND TRADEMARK OFFICE

CERTIFICATE OF CORRECTION

PATENT NO. : 5,566,820

DATED : October 22, 1996

INVENTOR(S) : Timothy E. Deaton

It is certified that error appears in the above-indentified patent and that said Letters Patent is hereby corrected as shown below:

Column 6, line 9, delete "from" and insert --front--;

Column 6, line 10, delete "from" and insert --front--.

Signed and Sealed this

Tenth Day of December, 1996

*Attest:*

*Attesting Officer*

BRUCE LEHMAN

*Commissioner of Patents and Trademarks*